US006055729A

United States Patent [19]

Suzuki

[11] Patent Number: 6,055,729

[45] Date of Patent: May 2, 2000

[54] METHOD FOR MANUFACTURING A LIQUID JET RECORDING HEAD

[75] Inventor: Toshio Suzuki, Sagamihara, Japan

[73] Assignee: Canon Kabushiki Kaisha, Tokyo, Japan

[21] Appl. No.: 08/772,917

[22] Filed: Dec. 24, 1996

[30] Foreign Application Priority Data

Dec. 24, 1995 [JP] Japan ..... 7-351844
Dec. 26, 1995 [JP] Japan ..... 7-351537

[51] Int. Cl.[7] ..... B41J 2/01; B41J 2/16

[52] U.S. Cl. ..... 29/890.1; 83/875; 347/47; 407/31; 407/60

[58] Field of Search ..... 29/890.1, 611; 83/596, 875; 407/31, 34, 60; 347/47

[56] References Cited

U.S. PATENT DOCUMENTS

| | | | |
|---|---|---|---|
| 543,608 | 7/1895 | Beale | 407/60 |
| 4,313,124 | 1/1982 | Hara . | |
| 4,334,234 | 6/1982 | Shirato et al. | 347/65 |
| 4,345,262 | 8/1982 | Shirato et al. . | |
| 4,459,600 | 7/1984 | Sato et al. . | |
| 4,463,359 | 7/1984 | Ayata et al. . | |
| 4,558,333 | 12/1985 | Sugitani et al. . | |
| 4,608,577 | 8/1986 | Hori . | |
| 4,657,631 | 4/1987 | Noguchi | 156/655 |
| 4,723,129 | 2/1988 | Endo et al. . | |
| 4,740,796 | 4/1988 | Endo et al. . | |
| 4,844,666 | 7/1989 | Tsujimura et al. | 407/34 |
| 4,878,992 | 11/1989 | Campanelli | 156/633 |
| 5,581,285 | 12/1996 | Watanabe et al. | 347/45 |

FOREIGN PATENT DOCUMENTS

| | | |
|---|---|---|
| 0484983 | 5/1992 | European Pat. Off. . |
| 0573014 | 12/1993 | European Pat. Off. . |
| 0594110 | 4/1994 | European Pat. Off. . |
| 0678387 | 10/1995 | European Pat. Off. . |
| 3700754 | 7/1987 | Germany . |
| 54-56847 | 5/1979 | Japan . |
| 59-123670 | 7/1984 | Japan . |
| 59-138461 | 8/1984 | Japan . |
| 60-71260 | 4/1985 | Japan . |

*Primary Examiner*—P. W. Echols
*Attorney, Agent, or Firm*—Fitzpatrick, Cella, Harper & Scinto

[57] ABSTRACT

A method for manufacturing a liquid jet recording head comprises the steps of obtaining a laminated body by laminating a liquid path formation layer forming liquid paths on a metallic base board having discharge energy generating elements on it, forming an orifice surface by cutting the laminated body thus obtained, and grinding the orifice surface thus formed by use of a cutting tool or a milling cutter. With this method that uses a metallic base board, it is possible to obtain a high-performance yet an inexpensive liquid jet recording head without any defects on the orifice surface, which contributes to implementing more stabilized liquid discharge.

7 Claims, 12 Drawing Sheets

METHOD FOR MANUFACTURING A LIQUID JET RECORDING HEAD

BACKGROUND OF THE INVENTION

1. Field of the Invention

The present invention relates to a liquid jet recording head used for a liquid jet recording apparatus of a bubble jet type or the like which discharges recording liquid (ink) from orifices (discharge ports) as droplets. The invention also relates to a method of manufacture for such head, and a liquid jet recording apparatus upon which is mounted a liquid jet recording head manufactured by such method.

2. Related Background Art

A liquid jet recording apparatus of a bubble jet type or the like is insensitive to external disturbances, and provides a good rate of recording. Therefore, such an apparatus is suited to performing high-speed printing with good precision, and in colors, among its other advantages. The future of this type of apparatus is promising. As shown in FIGS. 13A and 13B, a liquid jet recording head used for a liquid jet recording apparatus of the kind is provided with a base board 1001 having discharge energy generating elements, and a nozzle layer (liquid path formation layer) 1002 that forms liquid paths 1002*b* conductively connected to orifices (discharge ports) 1002*a* and a liquid chamber. Generally, there are formed on the base board 1001 discharge energy generating elements 1011 by the known technique of photo-lithography after an $SiO_2$ thermal oxidation film 1001*a* is provided on a monocrystal Si substrate. The surface thereof is covered by an electric insulation layer of $SiO_2$, SiC, $Si_3N_4$, or the like, and also, by a protection layer 1001*b* formed by Ta film or the like for the prevention of damage (such as cavitation erosion) that would otherwise be caused to the discharge energy generating elements due to mechanical shocks occurring when recording liquid is discharged. Here, if necessary, a film of $Ta_2O_5$, or the like is provided between the electric insulation layer and the Ta film in order to strengthen the contact between them. Also, on the nozzle layer 1002, a glass ceiling plate 1003 and others are arranged with an injection inlet to supply ink or other recording liquid.

A liquid jet recording head of this kind is generally manufactured by the steps of:

- coating a photoresist on the base board having discharge energy generating elements on it;
- providing a resist pattern having an inverted shape of the nozzle layer by causing the board thus coated to be exposed and developed;
- covering the board thus prepared with the glass ceiling plate, and then, injecting molten resin into the space on the circumference of the resist pattern;
- hardening the resin and forming the orifice surface by cutting the workpiece along a predetermined cutting face; and lastly,
- eluting the resist pattern by use of a solution to form each of the liquid paths on the nozzle layer.

In place of the injection molding method described above, there is another method for forming the nozzle layer wherein a photohardening resin is coated on the base board having a resist pattern on it, and then, after the glass ceiling plate is installed on it, a beam is irradiated from above it to harden the resin. In this case, too, such steps are needed that after the resin is hardened, the workpiece is cut along a predetermined face, and that the resist pattern is eluted.

In order to enhance the production of the liquid jet recording heads, a method is adopted in which when the head is manufactured the nozzle layers are laminated for a portion of plural liquid jet recording heads on a base board having a large area, such as a six-inch or an eight-inch wafer as in the case of a semiconductor process, and then, the laminated body is cut cut up using a cutting blade to form the individual liquid jet recording heads, and that the cutting faces which define the orifice surfaces are ground and polished for finishing.

However, in accordance with the conventional techniques described above, the nozzle layers are laminated on a large base board for a portion of plural liquid jet recording heads, and the laminated body thus obtained is cut up into each of the liquid jet recording heads. This cutting process is performed using a cutting blade adopted from a usual semiconductor process, which has a cutting width of several tens of $\mu$m to one mm. Therefore, as shown in FIG. 14, it is impossible to avoid creating a chipped portion $V_1$ on the base board 1001 with respect to the cutting face of the liquid jet recording head, which is an orifice surface, a chipped portion $V_2$ on the nozzle layer 1002, or a crack $V_3$ on the nozzle layer 1002.

Compared with the chipped portion $V_2$ and the crack $V_3$ on the nozzle layer 1002, the chipped portion $V_1$ on the base board, in particular, tends to adversely effect to a considerable extent the shapes of the discharge ports 1002*a* and liquid paths 1002*b* on the nozzle layer 1002. For example, if an Si substrate of 0.5 mm or more in thickness is used for the basic material for the base board 1001, the discharging direction of ink is conspicuously changed, thus resulting in twisted printing, as well as other defects, because the depth of the chipped portion $V_1$ of the base board 1001 may be as much as 10 $\mu$m or more.

This is due to the fact that the basic material from which the base board is formed is a Si substrate, which is hard and brittle, and the heat accumulation layer, protection layer, and others provided on it are also formed mainly from $SiO_2$, which is equally hard and brittle. As a result, the base board has properties as whole making it extremely likely to be chipped off or otherwise damaged.

SUMMARY OF THE INVENTION

The present invention is designed with a view to solving the problems encountered in the conventional techniques described above. It is an object of the invention to provide a high-performance but inexpensive liquid jet recording head having no defects such as chipped portions on the orifice surface at which the orifices (discharge ports) open, and also, to provide a method of manufacture therefor, and a liquid jet recording apparatus having such a liquid jet recording head mounted thereon.

Meanwhile, among such liquid jet recording heads, an elongated head typically arranged by a head of a full-line type, which corresponds to the maximum width of a recording medium such as a recording sheet, mounted on a metallic base board is often used. This is due to the fact that the round wafers currently available for the production of the Si substrate have a round configuration. Therefore, when fabricating elongated heads, it is natural that the number of individual heads obtainable therefrom is extremely limited. Also, the cost of the Si substrate is comparatively high. For the metallic base board, there are no problems which would lead to the creation of chipped portions and cracking as is encountered when the Si base board is cut as described earlier. Therefore, the present inventor and others have tried to produce liquid jet recording heads using metallic base boards in order to solve the problems described above. However, when using a metallic base board, the grinding jig used for grinding each orifice surface after cutting often becomes clogged. Thus, a new problem arises in that the production yield of liquid jet recording heads still cannot be increased easily.

The present invention is also designed in consideration of these technical problems yet to be solved in the conventional techniques. It is an object of the invention to provide a method for manufacturing a high-performance liquid jet recording head whose production yield is high yet which still does not suffer from defects such as chipped portions on the base board with respect to the orifice surface to which orifices (discharge ports) are open, and also, to provide a liquid jet recording head manufactured by such method of manufacture, and a liquid jet recording apparatus having mounted thereon such a liquid jet head.

In order to achieve the objects described above, the method for manufacturing a liquid jet recording head of the present invention comprises the steps of obtaining a laminated body where liquid path formation layer is laminated to form liquid paths on a metallic base board having discharge energy generating means on it; forming the orifice surface by cutting the laminated body thus obtained, and grinding the orifice surface thus formed by means of a cutting tool or a milling cutter.

In accordance with the present invention, the burrs created on the orifice surface of a metallic base board, which base board has been cut off by use of a general blade or the like for cutting use, can be removed by use of a cutting tool whose tip is made of diamond or the like or a milling cutter arranged likewise for finishing and smoothing the orifice surface. In this way, it is possible to obtain a high-performance liquid jet recording head whose discharging is stabilized through the production of a smooth and perfect orifice surface.

Further, since the base board is formed with a metallic substrate, it can be produced at low cost as compared with the conventional method in which a Si substrate is used as a thin material. In addition, the metallic substrate has superior heat radiation. These advantages significantly contribute to providing a higher performance liquid jet recording head at lower costs.

BRIEF DESCRIPTION OF THE DRAWINGS

FIG. 2A is a partial perspective view showing the principal part of the liquid jet recording head in such steps of manufacture. FIG. 2B is a cross sectional view taken along line 2B—2B in FIG. 2A.

FIG. 4A is a cross-sectional view which schematically shows the liquid jet recording head in such a finishing step and a diamond cutting tool.

FIGS. 4B and 4C are a plan view and a side view showing only the diamond cutting tool, respectively.

FIG. 5A is a cross-sectional view which schematically shows the liquid jet recording head in such finishing step and the end mill.

FIGS. 5B and 5C are an elevational view and a side view showing only the end mill, respectively.

FIG. 6A is a view which illustrates the method for manufacturing a liquid jet recording head.

FIG. 6B is an elevated sectional view which shows the side milling cutter.

FIG. 6C is a view which illustrates the dimensional relationship between the cutting tool and the finishing tool shown in FIG. 6B.

FIGS. 8A and 8B are a side view and an elevational view showing the cutting tool and its shank, respectively.

FIGS. 8C and 8D are a side view and an elevational view showing the finishing tool and its shank, respectively.

FIG. 9A is the side view thereof.

FIG. 9B is a view which illustrates each edge width of the tools.

FIG. 13A is a perspective view which shows the principal part thereof.

FIG. 13B is a cross-sectional view taken along line 13B—13B in FIG. 13A.

DETAILED DESCRIPTION OF THE PREFERRED EMBODIMENTS

The present invention will be described in detail with reference to the accompanying drawings.

First Embodiment

Now, in conjunction with FIGS. 1, 2A, 2B, 3, 4A, 4B and 4C, a first embodiment will be described in accordance with the present invention.

Figure 1:
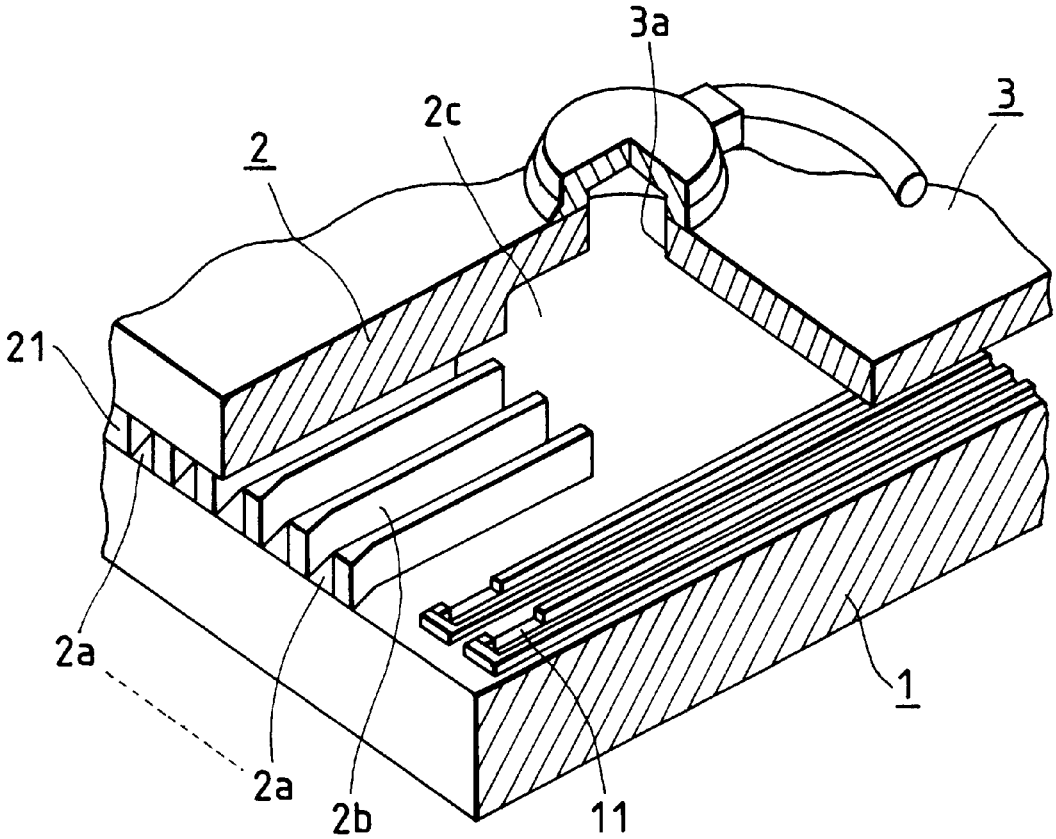
FIG. 1 is a partly broken partial perspective view which shows the principal part of a liquid jet recording head in accordance with a first embodiment of the present invention.

FIG. 1 shows a liquid jet recording head of the first embodiment thereof, which comprises a base board 1 having discharge energy generating elements 11, and a nozzle layer (liquid path formation layer) 2 that forms liquid paths 2*c* conductively connected to orifices (discharge ports on the orifice surface) 21 and a liquid chamber 2*c*. The base board 1 is formed from an aluminum substrate serving as a metallic base board having a sputtered $SiO_2$ film provided thereon as a heat accumulation layer, and then, by means of known photolithography the discharge energy generating elements 11 are formed. The surface thereof is covered by an electric insulation layer formed from $SiO_2$, SiC, $Si_2N_4$, or the like, and a protection layer and other layers are formed from a Ta film or the like to prevent any damage (such as cavitation erosion) from being caused to the discharge energy generating elements due to mechanical shocks when recording liquid is discharged. If needed, a $Ta_2O_5$ film or the like is provided between the electric insulation layer and the Ta layer in order to strengthen the contact between them. Also, there is arranged on the nozzle layer 2, an aluminum ceiling plate 3 and other layers serving as a second base board having an injection inlet 3*a* thereon to supply ink or other recording liquid.

Figure 2A:
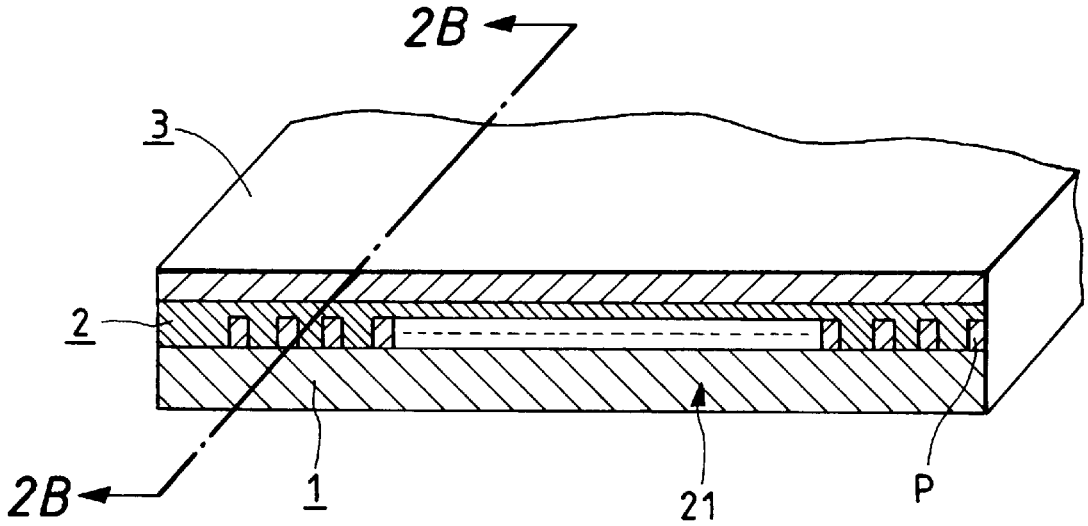
FIGS. 2A and 2B illustrate the steps of manufacturing the liquid jet recording head shown in FIG. 1.
Figure 2B:
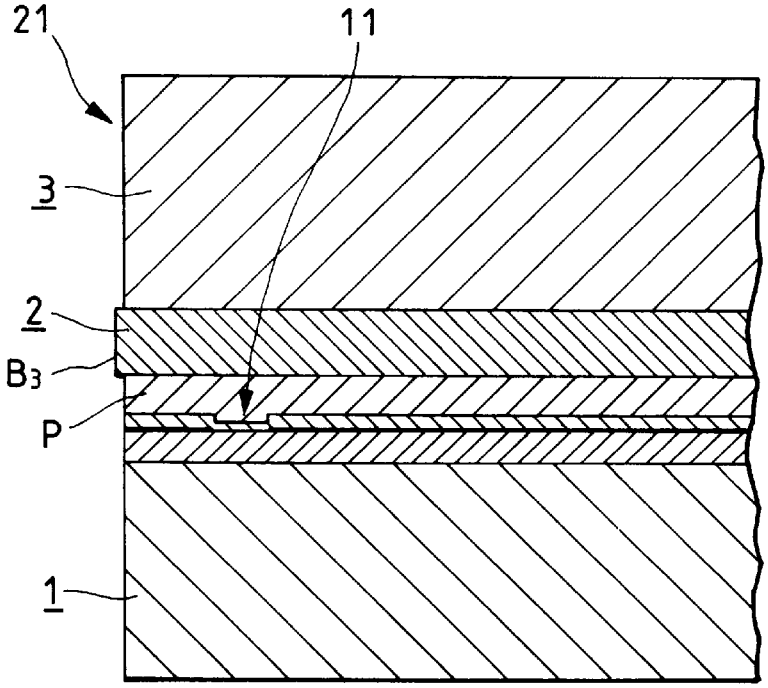

This liquid jet recording head is manufactured by the following steps:

As shown in FIGS. 2A and 2B, a photoresist is coated on the base board 1 having the discharge energy generating elements 11 thereon. The photoresist thus coated is exposed and developed to provide a resist pattern P having the inverted shape of the nozzle layer 2, and is then covered with the aluminum ceiling plate 3 which serves as the second base board. Molten resin is injected into the space on the circumference of the resist pattern P and is hardened to obtain a laminated body. An orifice surface 21 is formed by cutting this body along the predetermined cutting face. Lastly, by use of solution, the resist pattern P is eluted to form each of the liquid paths 2*b* and the liquid chamber 2*c* on the nozzle layer 2 formed by resin as described earlier.

In place of the foregoing method, another method for forming a nozzle layer can be used in which a photohardening type resin is coated on a base board having a resist pattern on it, and after installing a transparent ceiling plate on it, a beam is irradiated from above the ceiling plate to harden the resin to form the nozzle layer. In this case, too, it is necessary to cut the hardened resin along the predetermined cutting face, and also to elute the resist pattern.

In order to enhance the productivity of liquid jet recording heads, a method is adopted in the actual steps of head manufacture in which the nozzle layer for a portion of plural liquid jet recording heads is formed on a large area substrate such as a six-inch or eight-inch wafer as in the semiconductor process, and the laminated body thus obtained is cut off using a cutting blade into each of the liquid jet recording heads, and then, the orifice surface is ground and polished for finishing.

As described earlier, an aluminum base board 2 mm thick is used for the base board 1 instead of the Si base board that has been used in the conventional art. The heat accumulation layer is mainly formed by an $SiO_2$ film 2.7 $\mu$m thick, and the protection layer is mainly formed by an $SiO_2$ film 1.3 $\mu$m thick. Also, the ceiling plate 3 is formed from aluminum rather than the glass that has been used in the conventional art.

Since the base board 1 is formed from aluminum (a metallic base board), which is a ductile material, one benefit is that chipped portions are not readily formed in comparison to the Si base board. Furthermore, it is inexpensive, has good heat radiation, and also presents excellent smoothness, among other advantages. Therefore, using an aluminum base board it is possible to obtain a liquid jet recording head whose discharge performance is stabilized without any chipped portions on its orifice surface. Moreover, by virtue of the good heat radiation, it is possible to provide a higher discharge frequency, while obtaining a good adhesive coverage of a thin film pattern of 0.1 $\mu$m to several $\mu$m in the step of forming discharge energy generating elements, because the surface of the aluminum base board is smooth and flat. This contributes to another advantage in that the wiring is not easily broken. Here, instead of aluminum, it may be possible to use copper, brass, or other metals for the metallic base board, provided such metallic material has good ductility, and cut machinability as well.

Figure 3:
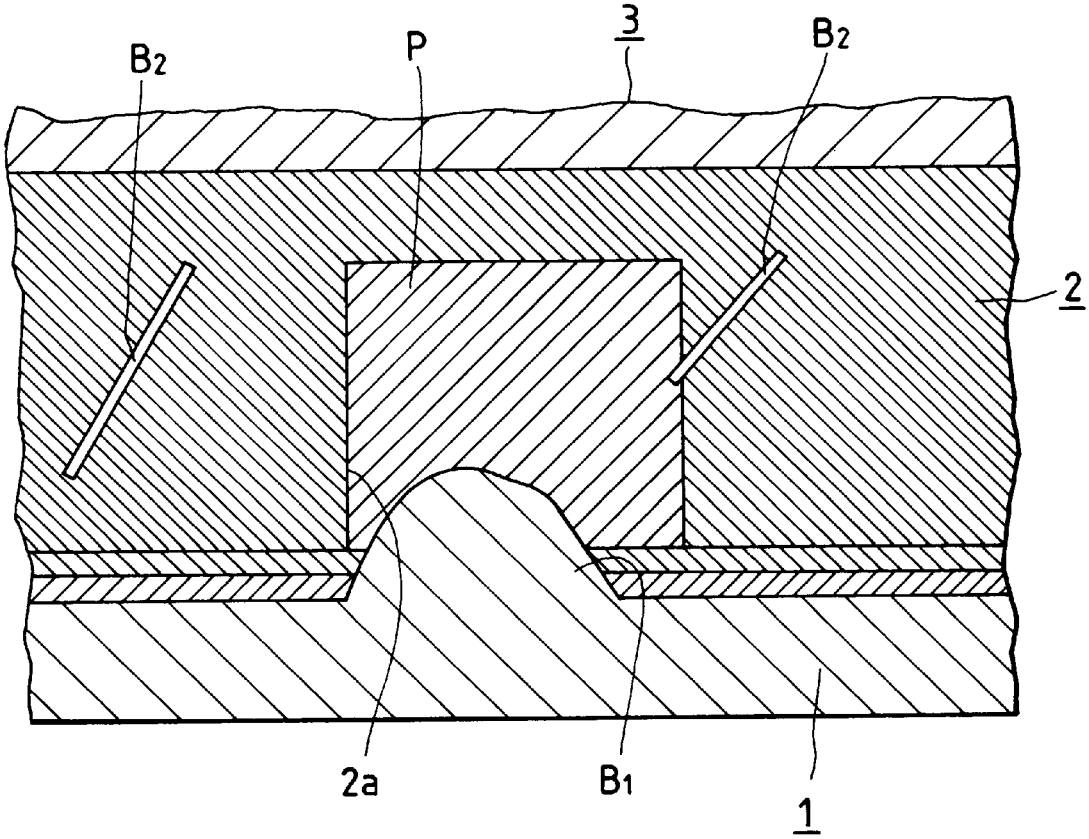
FIG. 3 is a partially enlarged view which shows a part of the orifice surface of the liquid jet recording head represented in FIGS. 2A and 2B.

In the cutting step, it is found that the metal bonded diamond edge in conventional use becomes heavily clogged, making cutting impossible. Consequently, a resin bonded GC (silicon carbonate) blade is used. In other words, cutting is performed using a resin bonded GC edge whose grain size is 320; diameter, 125 mm; thickness, 0.9 mm; at 4,600 rpm with a feeding speed of 180 mm/min. On the cutting face (orifice surface) 21, a burr $B_1$ is created in this stage as shown in FIG. 3 in a shape that closes orifice 2*a*.

Although a resin bonded edge or a resin bonded diamond edge could be used for cutting, the burr $B_1$ is created in either case.

The resist pattern P has yet to be removed, but the burr $B_1$ in the lower part of the nozzle layer 2 is quite large. It partially clogs the orifice 2*a*. Also, chips $B_2$ are produced on the nozzle layer 2. It is also found that an extrusion $B_3$ is created on the orifice surface 21 (see FIG. 2B and FIG. 4A).

Figure 4A:
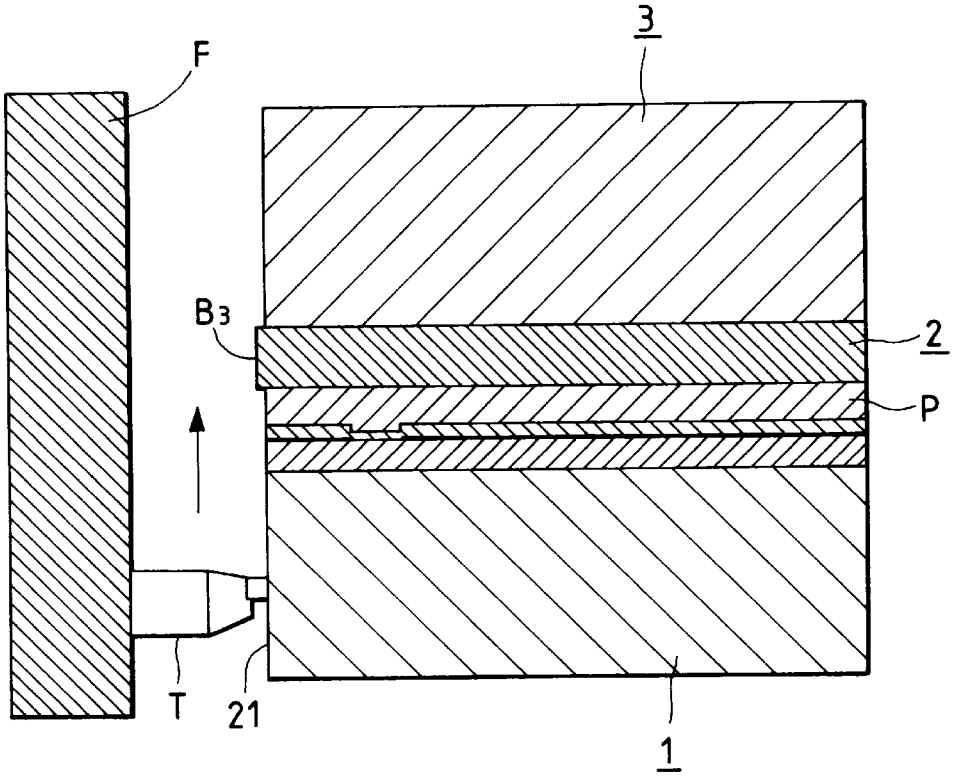
FIGS. 4A, 4B and 4C illustrate the step of finishing the liquid jet recording head shown in FIGS. 2A and 2B.
Figure 4B:
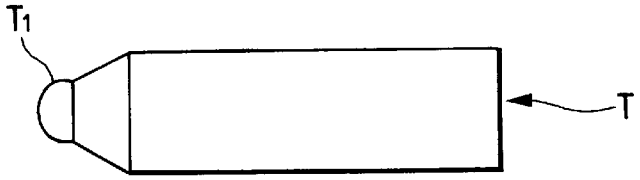
Figure 4C:
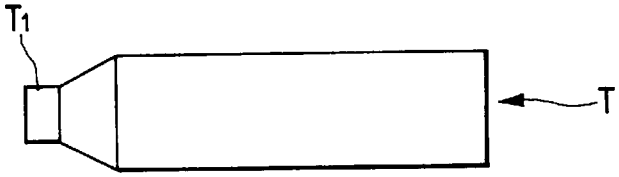

Therefore, as shown in FIG. 4A, finish cutting is performed using a diamond cutting tool T. As shown in FIGS. 4B (plan view) and 4C (side view), the diamond cutting tool (JISB10107) T is provided with a diamond tip $T_1$ for to form mirror finished aluminum alloy or the like. Here, it may be possible to use a diamond-tipped milling cutter (JIS0172) or a cemented carbide cutting tool or milling cutter for the finishing cut.

By the use of the diamond tip $T_1$ for finish cutting as described above, it is possible to remove the burr B and the extrusion $B_3$ created on the orifice surface in the cutting step.

The finish cutting is performed under the condition given below. A diamond cutting tool T (diamond curvature: 10 mm) is mounted on a flange F having a diameter of 100 mm. The cutting step is repeated five times each at 4,600 rpm, with a feeding speed of 46 mm/min, and for a feed amount of 10 $\mu$m. The liquid jet recording head thus produced is used for printing tests with the result that excellent printing properties are obtained.

In place of the diamond cutting tool, a cemented carbide cutting tool is also used for finish cutting. In this case, too, test results show excellent printing properties. However, it is found that the diamond cutting tool is preferable, because when it is used the unwanted elements that may be created on the orifice surface are smaller.

Now, description will be made of a variation on the first embodiment in accordance with the present invention.

Figure 5A:
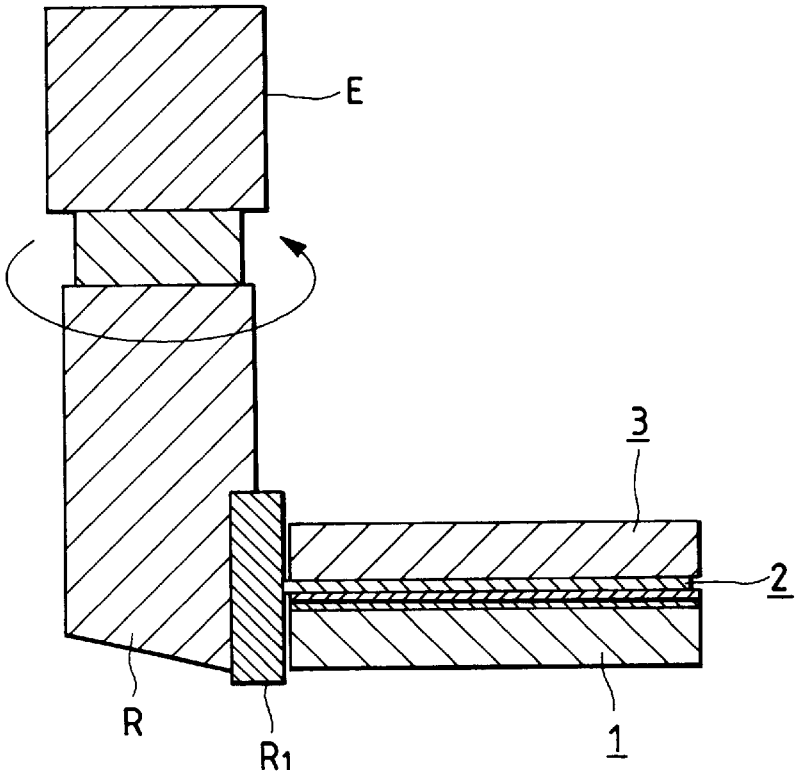
FIGS. 5A, 5B and 5C illustrate the step of finishing the liquid jet recording head using an end mill instead of the diamond cutting tool.
Figure 5B:
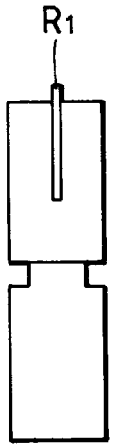
Figure 5C:
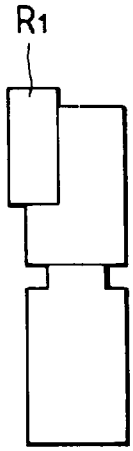

FIGS. 5A, 5B and 5C are views which show such examples. In accordance with this example, a liquid jet recording head is manufactured by use of an end mill E having a diamond cutting tool R as shown in FIG. 5A for its finish cutting. Other aspects involving the use of this end mill are the same as those described in the first embodiment. With the end mill E, the roughness of the cutter edge is transferred to the orifice surface, because the feeding direction of the base board 1 is the same as the rotational direction of the cutter or it is opposite thereto. Therefore, instead of the usual diamond end mill that uses a sintered compact, the tip $R_1$ is formed by natural diamond for use as shown in FIGS. 5B and 5C, which are the elevated and side views thereof, respectively, in order to reduce the surface roughness of the orifice. Here, the cutting conditions are such that an end mill of 10 mm diameter having its edge of 5 mm long is used at 15,000 rpm with the feeding speed of 150 mm/min for a feed amount of 10 $\mu$m per cutting step. This step is repeated five times.

As compared with the use of a milling cutter, this cutting setup results in a better orifice configuration above the ceiling plate as well as below the base board. A further advantage is that the extrusions remaining on the nozzle layer are smaller. In this respect, each of the finishes obtained by use of the sintered diamond and cemented carbide end mills is examined, and it is found that each indicates excellent printing properties. However, in consideration of the frequency with which defects are found on the orifice surface, it is preferable to use the sintered diamond over the cemented carbide, and the natural diamond over the sintered diamond.

For the materials of the base board and the ceiling plate, it may be possible to use copper, brass, or some other metal that contains aluminum as its main component, besides aluminum itself, provided such metallic material has an excellent cut machinability.

Now, as a second variation on the first embodiment of the present invention, a liquid jet recording head is manufactured in the same manner as the first embodiment save that the ceiling plate is formed from phenol resin containing a filler, rather than aluminum. Because of the filler contained in the phenol resin, the linear expansion coefficient thereof is made equal to that of aluminum. An advantage of this ceiling plate over the aluminum ceiling plate is that it is easier to be formed with an incorporated ink supplying system, and so the liquid jet recording head can be manufactured for lower cost.

Also, there is another advantage in that both the cutting and the finish cutting are easier as compared with that required for the aluminum ceiling plate.

As the material of the ceiling plate, it may be possible to use a polyetherimide containing a filler or pholyphenylene sulfide containing a filler, which provide a linear expansion coefficient closer to that of aluminum, rather than the filler-contained phenol resin.

Further, as a third variation on the first embodiment of the present invention, a liquid jet recording head is manufactured in the same manner as the first embodiment, save that the ceiling plate is formed from polysulfone (PSF) instead of aluminum. With the ceiling plate formed from a PSF of the ultraviolet transmissive type, it becomes possible to use a photohardening injection resin for the formation of a nozzle layer. In this way, a time required for hardening can be shortened significantly. Also, another advantage is that the inner condition of the nozzles can be observed, among other things. However, since the linear expansion coefficient becomes larger than that of aluminum, warping tends to occur during the heating process when manufacturing the liquid jet recording heads in this way. There is a need for a temperature control. Also, there is a tendency for the shape of the ceiling plate to be more convex than that of the aluminum ceiling plate after cutting.

Instead of the polysulfone, it may be possible to use a polyethersulfone of ultraviolet type or amorphous polyolefin for the ceiling plate.

Second Embodiment

In accordance with the first embodiment of the present invention, the steps of cutting a liquid jet recording head and finishing the orifice surface are performed separately. However, the present embodiment presents a method for manufacturing a liquid jet recording head wherein the cutting and finishing steps are executed at the same time. The structural feature of the present embodiment is to adopt a side milling cutter for cutting the base board. Here, particularly, the side milling cutter is provided with a rotational body, and also, with a plurality of cutting tips held in different positions in the circumferential direction of the rotational body, and also, with driving means to rotate this rotational body. Here, one of the plural cutting tips is provided with a top cutting edge having a larger rotational radius than those of the tips of the other cutting edges. In this way, this side milling cutter serves as a cutting tool to form a cut groove on a work piece, while each of the remaining cutting tools are provided with the side cutting edge serving as finishing cutter to cut the side faces of the cut groove thus formed. In this respect, these finishing cutters may be held on the rotational body stepwise in the width direction of each cutting edge, respectively. Also, the width of cutting edge of the finishing cutter should preferably be larger in the circumferential direction of the rotational body as it is farther away from the one serving as the cutting tool.

With the structure thus arranged, the present embodiment helps to simplify the steps of manufacturing a liquid jet recording head, as well as to shorten significantly the duration of the manufacturing cycle. Also, the cutting and finish tools are held on the same rotational body for revolution. As a result, it is possible to reduce installation expenses and maintenance costs to a considerable extent as compared with the situation where separate cutting equipment is used in the cutting and the finishing steps, respectively.

Moreover, since the cutting and finishing steps are executed using different cutting tools, the cutting amount of each cutting tool is decreases compared with the case where the same cutting tool is used for both cutting and finishing. Therefore, it becomes possible to enhance the precision remarkably when finishing the orifice surface by use of a cutting tool dedicated only to the finish operation.

Further, since the cutting amount is reduced for each of the cutting tools, the width of each cutting edge can be made decreased. Consequently, there is an advantage that the width of the cut groove can be made smaller so that it is possible to obtain more liquid jet recording heads from one substrate.

Now, with reference to the accompanying drawings, description will be made of the second embodiment in accordance with the present invention.

Figure 6A:
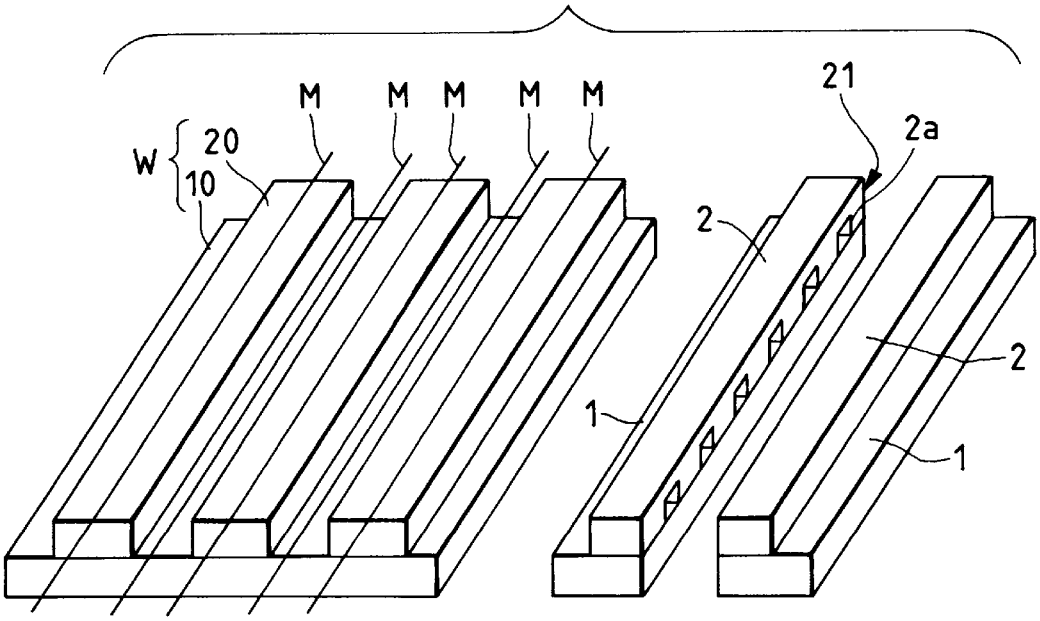
FIGS. 6A, 6B and 6C illustrate a side milling cutter and a method for manufacturing a liquid jet recording head in accordance with a second embodiment of the present invention.
Figure 6B:
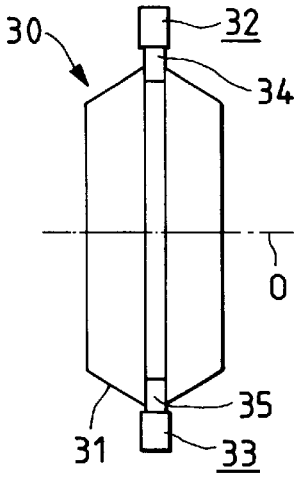
Figure 6C:
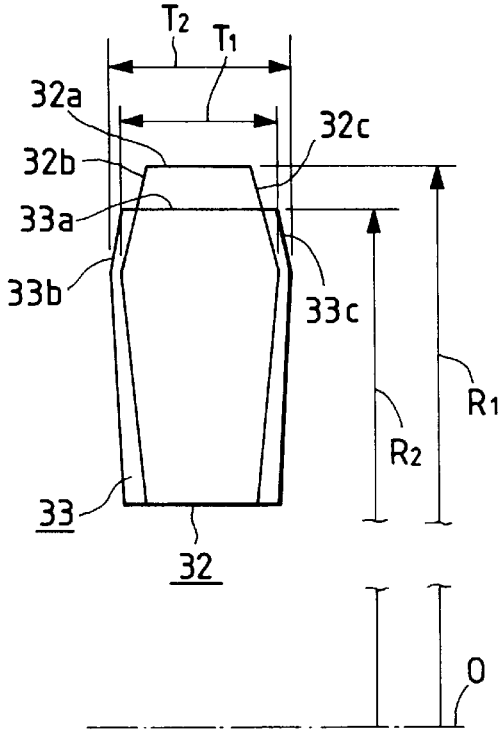

FIGS. 6A, 6B and 6C illustrate a side milling cutter and a method for manufacturing a liquid jet recording head in accordance with the present embodiment. As a finished product, the liquid jet recording head comprises a base board 1 having discharge energy generating elements, and a nozzle layer (liquid path formation layer) 2 that forms liquid paths that communicate with discharge ports (orifices) 2*a* on an orifice surface 21, and a liquid chamber. The base board 1 is formed from an aluminum substrate serving as a metallic base board having a sputtered $SiO_2$ film provided on it as a heat accumulation layer, and then, by means of known photolithography the discharge energy generating elements are formed. The surface thereof is covered by an electric insulation layer formed from $SiO_2$, SIC, $Si_3N_4$, or the like, and a protection layer and others formed from Ta film or the like to prevent damage (such as cavitation erosion) from being caused to the discharge energy generating elements due to mechanical shocks when recording liquid is discharged. If needed, a $Ta_2O_5$, film or the like is provided between the electric insulation layer and the Ta layer in order to strengthen the contact between them.

At first, in the same manner as in known semiconductor processes, a large area substrate 10, such as a six-inch or eight-inch wafer has a nozzle layer 20 for a portion of plural liquid jet recording heads laminated thereon to produce a laminated body W. By cutting the laminated body W along cutting lines M, each of the liquid jet recording heads is cut off. Here, a side milling cutter 30 shown in FIGS. 6B and 6C is used for the simultaneous execution of the cutting step to cut off each of the liquid jet recording heads and the finishing step to surface finish the orifice faces 21 of each liquid jet recording head.

The side milling cutter 30 is formed by holding a cutting tool 32 and a finishing tool 33 on the circumference of a circular flange 31 serving as a rotational body that rotates around the center of the rotational shaft 0. Both of the tools are mounted outwardly on the same diameter in the diametral direction of the circular flange 31.

Both the cutting tool 32 and finishing tool 33 are provided with trapezoidal cutting edges, respectively, and each of them is head on the flange 31 through each of shanks 34 and 35. As shown in FIG. 6C, the bottom width of the trapezoidal cutting edge of the cutting tool 32, that is, the edge width $T_1$, is smaller than the edge width $T_2$ of the finishing tool 33. Also, the tip of the cutting tool 32, that is, the rotational radius $R_1$ of the top side (leading edge) 32*a* of the trapezoidal cutting tool is larger than the rotational radius $R_2$ of the top side 33a at the tip of the trapezoidal cutting edge of the finishing tool 33.

When the circular flange 31 is rotated by a driving means (not shown), the cutting edge of the cutting tool 32 executes the cutting operation to cut the laminated body W, that is, a work piece, into each of the liquid jet recording heads by use of the top side 32*a* and both sides 32*b* and 32*c* of the trapezoid thereof, and then, in continuation, the cutting edge of the finishing tool 33 performs the finishing operation using only both sides (side edges) 33*b* and 33*c* to finish the orifice surface 21 of each of the liquid jet recording heads.

Figure 7:
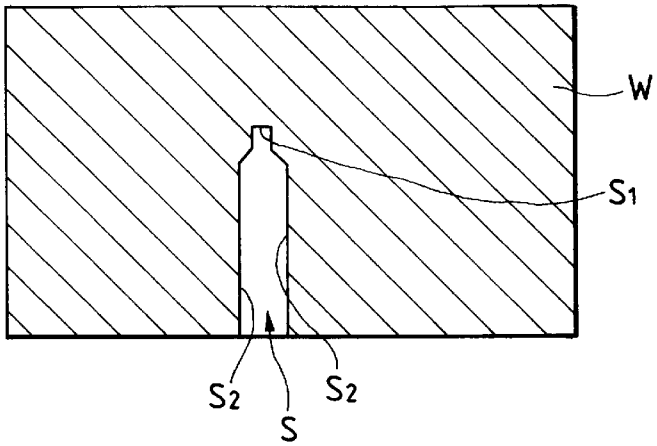
FIG. 7 is a view which shows a cut groove formed by the side milling cutter depicted in FIGS. 6A, 6B and 6C.
Figures 8A, 8B, 8C, 8D:
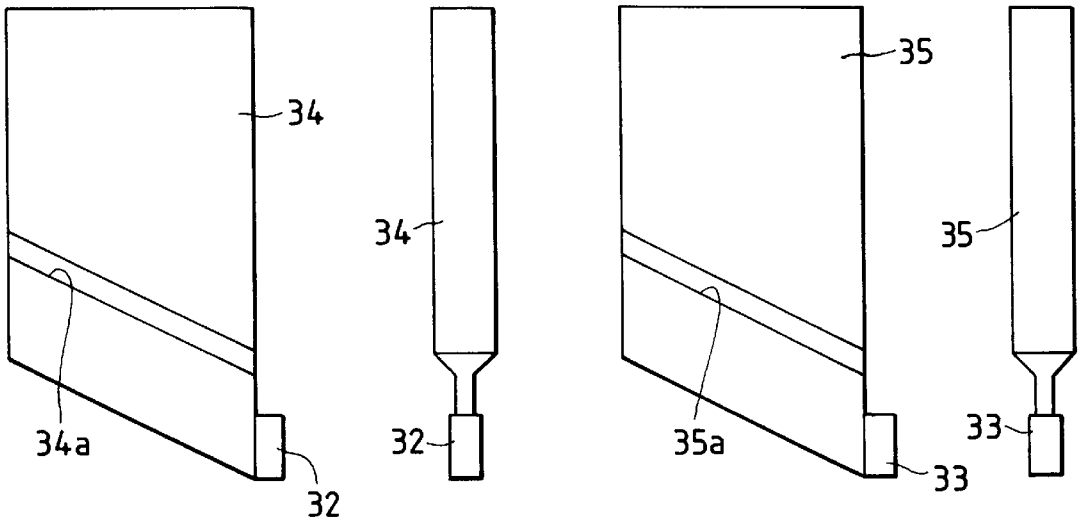
FIGS. 8A, 8B, 8C and 8D illustrate the cutting and finishing tools of the side milling cutter shown in FIGS. 6A, 6B and 6C together with a shank.

FIG. 7 illustrates the shape of a cut groove S that is formed on the laminated body during the simultaneous steps of cutting and finishing by the revolution of the circular flange 31 as described above. The tip $S_1$, of the cut groove S is formed by cutting tool 32, and the side face $S_2$ of the cut groove S is formed by finishing tool 33.

In order not to allow the tip 33*a* of the finishing tool 33 to cut the top end $S_1$, of the cut groove S formed by the cutting tool 32, it is necessary to satisfy the following relationships between the revolution of the circular flange 31, that is, the revolution N of the side milling cutter and the feeding speed F, and the rotational radii $R_1$ and $R_2$ of the finishing tool 33:

$$(R_1-R_2)>F/N/n$$

where n is the number of tools mounted on the circular flange 31.

Here, as shown in FIGS. 8A to 8D, guide grooves 34*a* and 35*a* are provided for the shanks 34 and 35 of the cutting tool 32 and finishing tool 33. Along these guide grooves, the mounting unit of the circular flange 31 is caused to move relatively to change the amounts of protrusions for the cutting tool 32 and finishing tool 33 in the respective diametral directions, hence adjusting the rotational radii $R_1$ and $R_2$ accordingly.

In accordance with the present embodiment, the laminated body is cut off into each of the liquid jet recording heads, and then, the finishing step of each orifice surface is executed by the separate tool. As a result, the amount of cutting for each tool can be kept small, and there is no need to use a tool whose edge width is great as in the case where the same tool is used for the cutting and finishing steps. Therefore, while there is no possibility that the number of liquid jet recording heads obtainable from one base board (wafer) is reduced, each orifice surface can be finished in an extremely fine manner. Also, with the cutting and finishing tools being mounted on one and the same circular flange for revolution, there is no possibility that the steps of manufacturing liquid jet recording heads will become complicated, and that the installation expenses and maintenance costs higher, in contrast to the case where each of the cutting and finishing tools should be rotated individually.

As a result, the manufacturing costs of liquid jet recording heads are significantly reduced.

In this respect, the cutting edge of the cutting tool can be either a sintered diamond or a cemented carbide, but it is desirable to use a natural diamond for the cutting edge of the finishing tool.

Now, a specific example will be described.

Liquid jet recording heads are cut and finished using a natural diamond cutting tool having an edge width of 900 microns, and also, a natural diamond finishing tool having an edge width of 1,000 microns.

The revolution N is set at 4,600 rpm with the feeding speed F of 120 mm/min.

Now that the number n of tools is 2, the feeding speed f per tool is:

$$f=F/N/n$$

Therefore, it is 13 microns. Now, with a setup being arranged at $(R_1-R_2)>13$ microns, the tip of the finishing tool is not allowed to execute any cutting.

Here, it is important that $R_1$, and $R_2$ be defined so that even when the revolution N and the feeding speed f change, the setup is always such that (R1−R2)>f. If the maximum feeding speed Fmax of an apparatus is 300/min, while the minimum revolution Nmin is 2,000 rpm, the maximum feeding amount fmax is 75 microns/tool. Therefore, it should be good enough if $(R_1-R_2)$ is chosen to be 100 microns. Here, each of the orifice surfaces of the liquid jet recording heads thus obtained as finished products is examined with the result: none of them present any burrs, scratches, and chippings. The results of printing tests are also favorable.

Figure 9A:
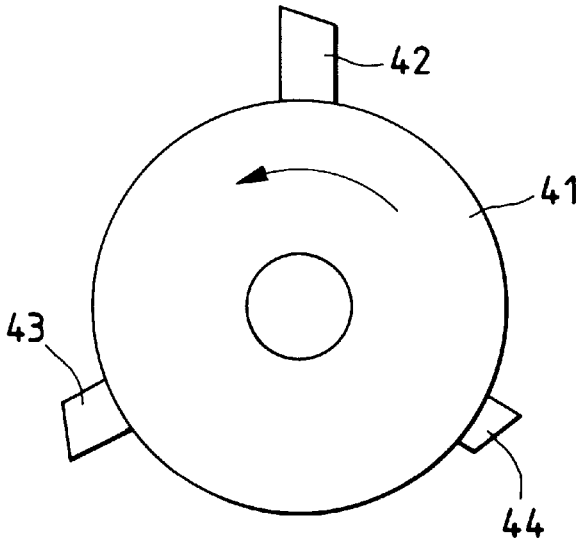
FIGS. 9A and 9B show another example of the side milling cutter in accordance with a second embodiment of the present invention.
Figure 9B:
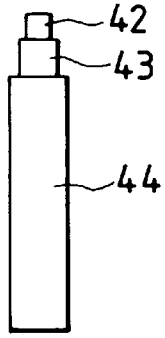
Figure 10:
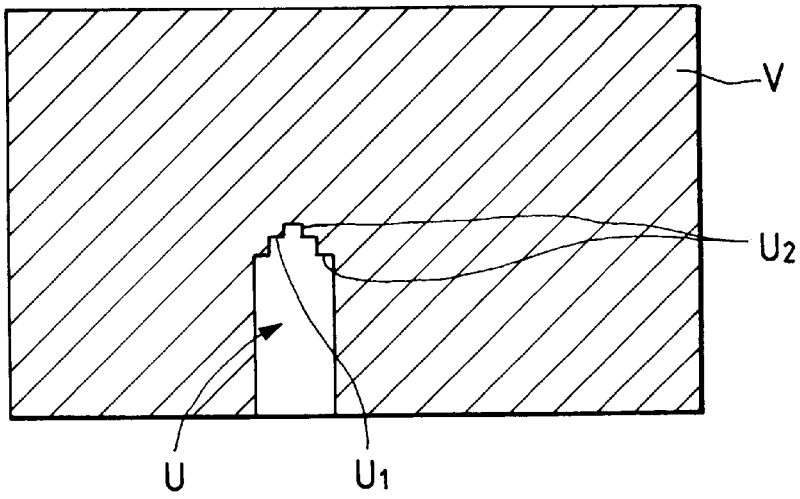
FIG. 10 is a view which shows a cut groove formed by the side milling cutter depicted in FIGS. 9A and 9B.
Figure 11A:
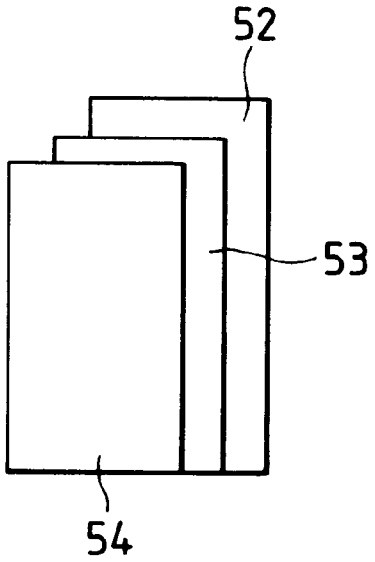
FIGS. 11A and 11B are views which illustrate two other examples, respectively.

FIG. 9 shows one variational example of the side milling cutter. This cutter has three tools 42 to 44, each having different edge width, mounted on the circumference of a circular flange 41 at equal intervals. Each edge width of the tools 42 to 43 is varied stepwise in the circumferential direction of the circular flange 41 as shown in FIG. 9B. The tool 42 having the smallest edge width is used to cut a laminated body into liquid jet recording heads. The remaining two tools 43 and 44 are used to finish each of the orifice surfaces. In this case, as shown in FIG. 10, the shape of a cut groove U formed on the laminated body V has two stages $U_1$ and $U_2$ at its top. Like this, a plurality of finishing tools may be arranged. Also, instead of tools having different edge widths, it may be possible to use tools 52 to 54 having the same edge width as shown in FIG. 11A, which are staged to be shifted in the direction of the edge width, that is, in the axial direction of the circular flange when mounted thereon.

Figure 11B:
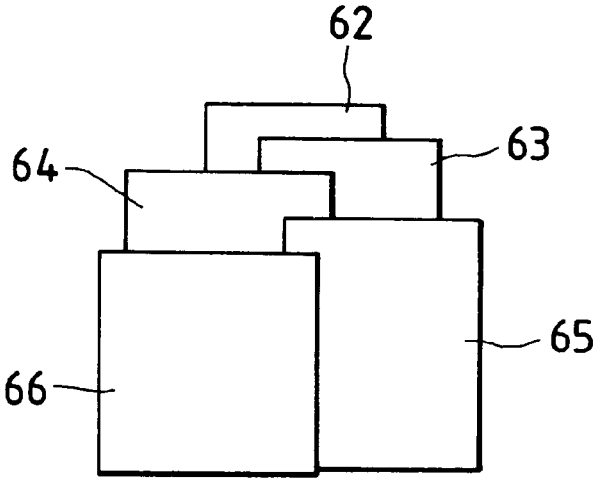

In this case, a cut groove is formed by the tool 52, which is the forerunner, and only one side of the orifice surface of the cut groove is finished by the remaining two tools 53 and 54. Further, as shown in FIG. 11B, tools 62 to 66 having the same edge width may be mounted on a circular flange in the direction of the edge width by shifting each of them alternately. With this arrangement, it is possible to finish both sides of the orifice surface of the cut groove.

Now, with reference to FIG. 12, the description will be made of a liquid jet recording apparatus to which a liquid jet recording head of the present invention is applicable.

Figure 12:
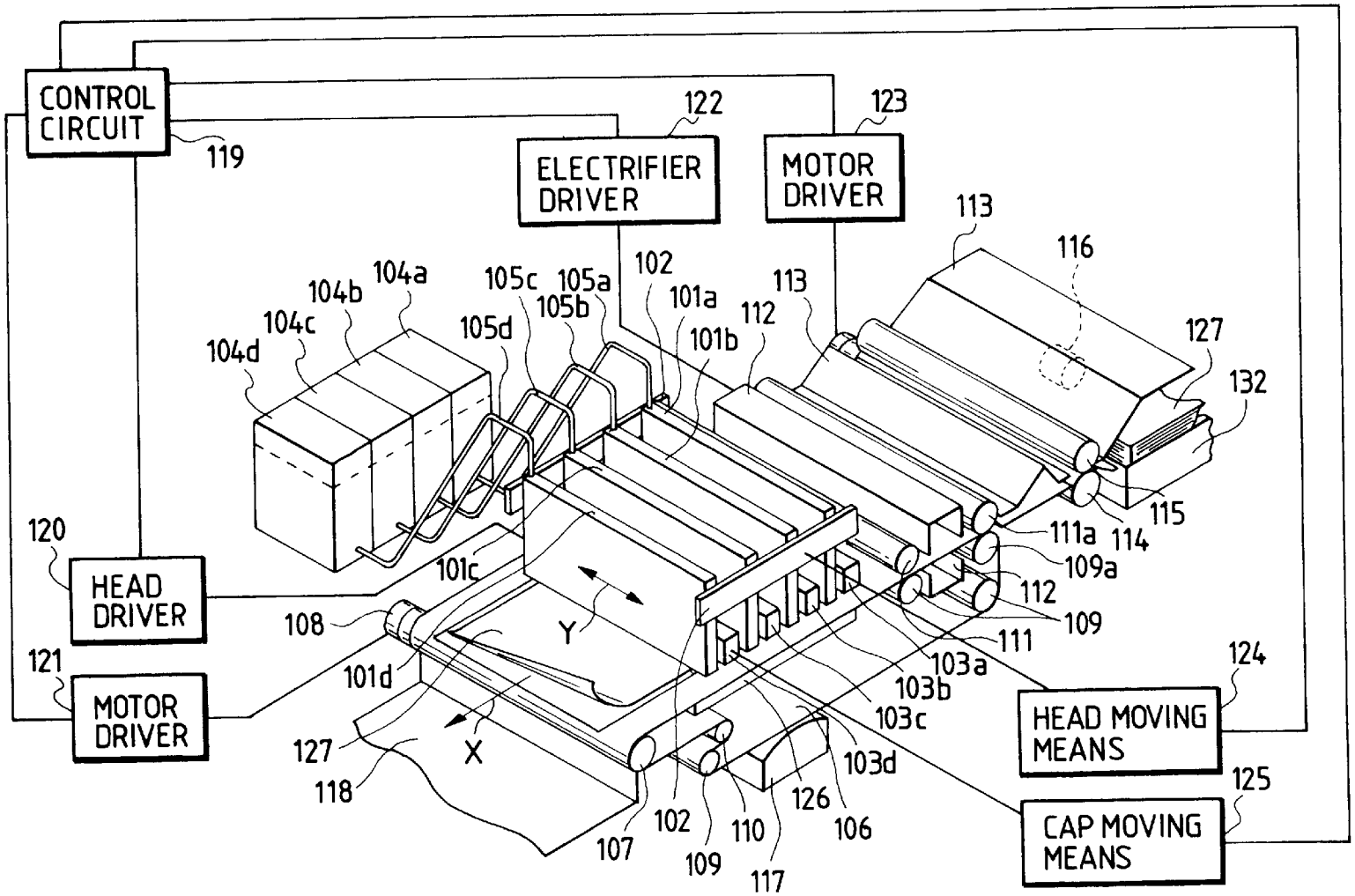
FIG. 12 is a view which schematically illustrates a liquid jet recording apparatus upon which can be mounted a liquid jet recording head according to the present invention.
Figure 13A:
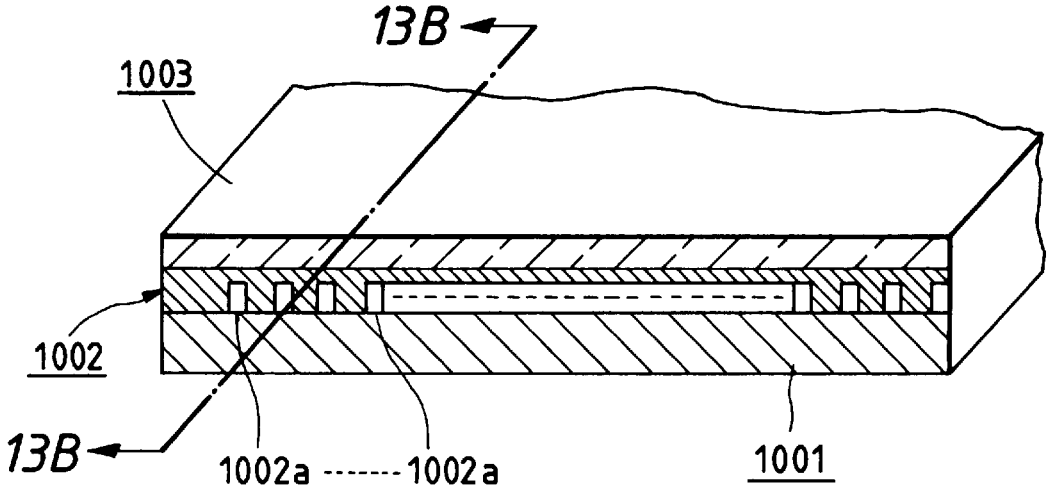
FIG. 13A PRIOR ART
FIGS. 13A and 13B show liquid jet recording heads in accordance with the prior art.
Figure 13B:
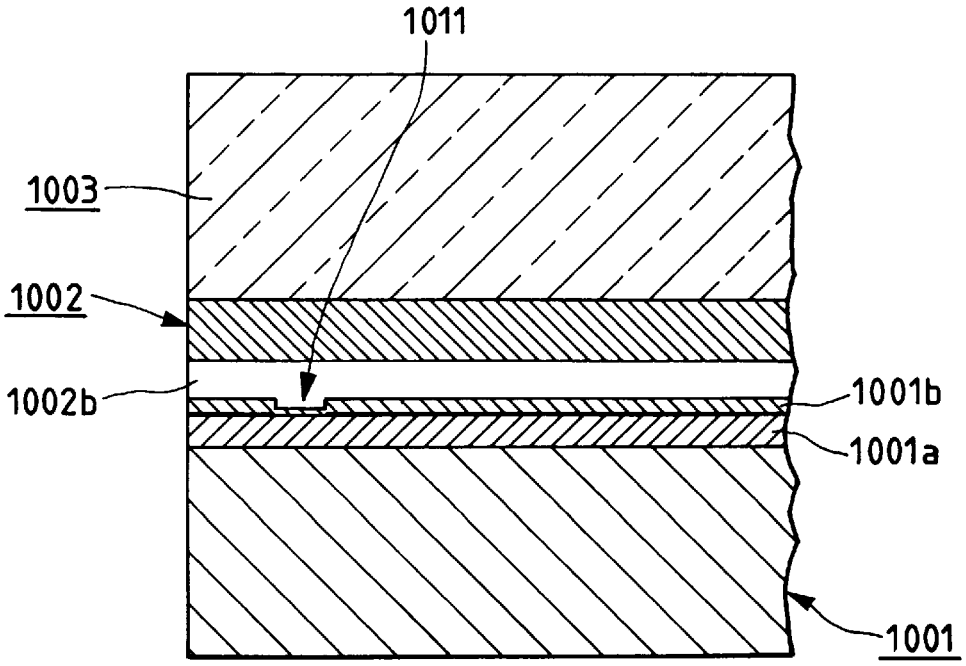
FIG. 13B PRIOR ART
Figure 14:
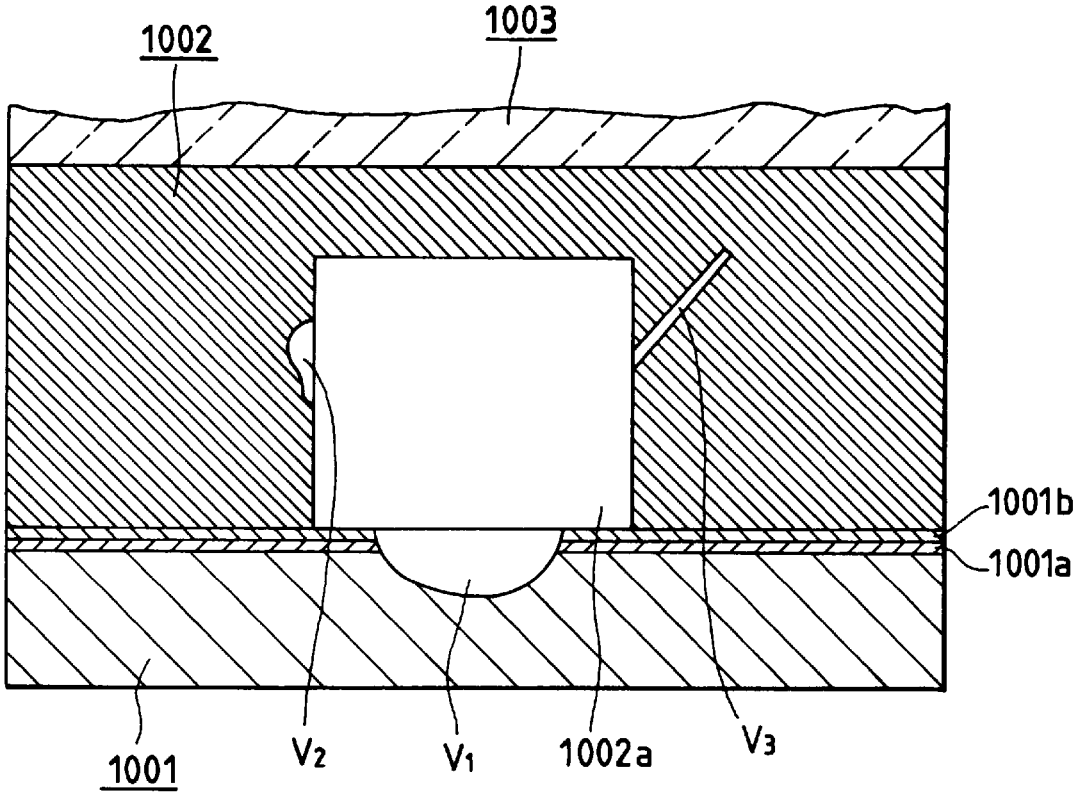
FIG. 14 PRIOR ART
FIG. 14 is a partially enlarged elevational view which shows a part of the orifice surface of the liquid jet recording head seen in FIGS. 13A and 13 2.

In FIG. 12, reference numerals 101*a* to 101*d* designate each of line type liquid jet recording heads (hereinafter referred to as a head), respectively. These heads are fixedly supported in parallel to each other by a holder 102, which serves as a supporting member, at given intervals in the direction indicated by an arrow X. On the bottom end of each of the heads 101*a* to 101*d*, 3,456 discharge ports are arranged downward in one line at an interval of 16 discharge ports/mm in the direction indicated by arrows Y. With this arrangement, it is possible to record over a width of 216 mm.

These heads 101*a* to 101*d* are of the type that discharges recording liquid using thermal energy. The discharge thereof is controlled by a head driver 120.

In this respect, a head unit is structured, which includes the heads 101*a* to 101*d* and the holder 102, and the head unit moves in the top and bottom directions by head moving means 124.

Also, each of the caps 103*a* to 103*d* arranged adjacent to the lower part of each of the heads 101*a* to 101*d* correspondingly is provided with an ink absorbent such as sponge in its interior, respectively.

The caps 103*a* to 103*d* are fixedly supported by a holder (not shown). Then, a cap unit is structured, which includes the holder and caps 103*a* to 103*d*. The cap unit moves in the direction indicated by the arrow X by cap moving means 125.

Cyan, magenta, yellow, and black inks are supplied to each of heads 101*a* to 101*d* from ink tanks 104*a* to 104*d* through each of the ink supply tubes 105*a* to 105*d*, respectively, thus making color recording possible.

Also, the ink supply is made using the capillary phenomenon created by the discharge ports of each head, and the liquid level of each of the ink tanks 104*a* to 104*d* is arranged lower by a specific distance than the position of discharge ports.

A belt 106 is a carrier means that carries a recording sheet 127, which serves as a recording material, and formed by a chargeable seamless belt.

The belt 106 is drawn around a driving roller 107, idle rollers 109 and 109*a*, and a tension roller 110 by way of a given path, and then is connected to the driving roller 107. The belt runs by a belt driving motor driven by means of a motor driver 121.

Also, the belt 106 runs in the direction indicated by the arrow X directly underneath the discharge ports of the heads 101*a* to 101*d*. Here, its lower side deviation is suppressed by means of a fixedly supporting member 126.

On the lower part where the belt 106 shown in FIG. 12, a cleaning unit 117 is arranged to remove paper and other particles adhering to the surface of the belt 106.

An electrifier 112 which charges the belt 106 is turned on and off by means of an electrifier driver 122. The recording sheet 127 is adsorbed to the belt 106 by electrostatic adsorption when the belt is charged.

Pinch rollers 111 and 111*a* are arranged at the front and rear of the electrifier 112, and these press a recording sheet 127 on the belt 106 to carry it in cooperation with the idler rollers 109 and 109*a*.

Recording sheets 127 contained in a sheet feeding cassette 113 are fed out one by one by the rotation of a sheet feeding roller 116. Then, by means of the carrier roller 114 and the pinch roller 115, which are driven by the motor driver 123, the sheet is carried to an angled guide 113 in the direction indicated by the arrow X. The angled guide 113 has an angled space that allows the recording sheet 127 to bend.

After recording, the recording sheet 127 is delivered to a tray 118 which receives delivered sheets.

The head driver 120, head moving means 124, cap moving means 125, the motor drivers 121 and 123, and the electrifier driver 122 are all controlled by a controller 119.

Of the various types of known liquid jet recording methods, the present invention demonstrates particularly excellent effects when it is applied to a recording head and a recording apparatus of the so-called ink jet recording method, which records by ejecting droplets using thermal energy.

Regarding the typical structure and operational principle of such a method, it is preferable for the present invention to adopt those which can be implemented using the fundamental principles disclosed in the specifications of U.S. Pat. Nos. 4,723,129 and 4,740,796, for example. This method is applicable to both the so-called on-demand type recording system and the continuous type recording system.

To briefly describe this recording method, discharge signals are supplied from a driving circuit to electrothermal transducing elements, which serve as discharge energy generating elements, disposed on a liquid (ink) retaining sheet or liquid path. In other words, in accordance with recording information, at least one driving signal is given in order to provide recording liquid (ink) with a rapid temperature rise so that film boiling phenomenon, which is beyond nuclear boiling phenomenon, is created in the liquid, thus generating thermal energy to cause film boiling on the thermoactive surface of the recording head. Since an air bubble can be formed from the recording liquid (ink) by means of the driving signal given to an electrothermal transducing element one to one, this method is particularly effective for a recording method of the on-demand type. By the development and contraction of the bubble, the liquid (ink) is discharged through a discharge port to produce at least one droplet. The driving signal is more preferably applied in the form of pulses because the development and contraction of the bubble can be effected instantaneously and appropriately. The liquid (ink) is discharged with quicker response. The driving signal in the form of pulses is preferably such as is disclosed in the specifications of U.S. Pat. Nos. 4,463,359 and 4,345,262. In this respect, the temperature increasing rate of the thermoactive surface is preferably such as is disclosed in the specification of U.S. Pat. No. 4,313,124 for an excellent recording in a better condition.

The structure of the recording head may be as shown in each of the above-mentioned specifications wherein the structure is arranged to combine the discharging ports, liquid paths, and the electrothermal transducing elements (linear type liquid passages or right-angled liquid passages). Besides, the structure such as is disclosed in the specifications of U.S. Pat. Nos. 4,558,333 and 4,459,600 wherein the thermal activation portions are arranged in a curved area is also included in the present invention.

Furthermore, the present invention is effectively applied to the structure disclosed in Japanese Patent Laid-Open Application No. 59-123670 wherein a common slit is used as the discharging ports for plural electrothermal transducing elements, and to the structure disclosed in Japanese Patent Laid-Open Application No. 59-138461 wherein an aperture for absorbing pressure waves of the thermal energy is formed corresponding to the discharge ports.

Further, the present invention is effectively applicable to a recording head of full-line type having a length corresponding to the maximum width of a recording medium recordable by the recording apparatus. For the full-line recording head, it may be possible to adopt either a structure whereby to satisfy the required length plural recording heads are combined, or a structure in which one recording head is integrally formed.

In addition, the present invention is effectively applied to an exchangeable recording head of a chip type that can be electrically connected with the apparatus main body, the ink supply therefor being made possible from the apparatus main body, when mounted on the apparatus main body or to the use of a cartridge type recording head provided integrally for the recording head itself.

Also, it is also preferable to provide a recording head with recovery means and preliminarily auxiliary means, because these additional means will contribute to stabilizing the effectiveness of a recording apparatus. Such means include capping means, cleaning means, suction or compression means, preheating means such as electrothermal transducing elements or heating elements other than such transducing elements or the combination of those types of elements, and a predischarge means for performing discharge other than the regular discharge with respect to the recording head.

Also, as the recording modes of a recording apparatus, the present invention is not only applicable to a recording mode in which only one main color such as black is used for recording, but also, is extremely effective when used in an apparatus having plural recording heads provided for the use of at least one of multiple colors prepared by difference colors or a full-color prepared by mixing colors, irrespective of whether the recording heads are integrally structured or structured by a combination of plural recording heads.

For the present invention, the most effective method applicable to various kinds of ink referred to in the preceding paragraph is the one that enables the film boiling method to be effectuated as described above.

Furthermore, as the mode of the recording apparatus of the present invention, it may be possible to adopt a copying apparatus combined with a reader, in addition to the image output terminal for a computer or other information processing apparatus. Also, it may be possible to adopt a mode of a facsimile equipment provided with transmitting and receiving functions.

In the embodiments of the present invention described above, while the ink has been described as liquid, it may be an ink material which is solidified when below room temperature but which softens or liquifies at the room temperature or which softens or liquifies within a temperature range of the temperature adjustment, that is, not lower than 30° C. but not higher than 70° C. applicable to the general liquid jet recording. In other words, if only ink is liquefied at the time of giving recording signals for use, any one of them should be good enough for use. In addition, while positively preventing the temperature from rising due to thermal energy by the use of such energy as an energy to be consumed for changing states of ink from solid to liquid, or by the use of the ink which will be solidified when left intact for the purpose of preventing the ink from being evaporated, it may be possible to adopt for the present invention the use of an ink having a nature of being liquefied only by the application of thermal energy, such as an ink capable of being discharged as ink liquid by enabling itself to be liquefied anyway when the thermal energy is given in accordance with recording signals, and an ink which will have already begun solidifying itself by the time it reaches a recording medium. In such a case, it may be possible to retain ink in the form of liquid or solid in the recesses or through holes of a porous sheet such as disclosed in Japanese Patent Laid-Open Application No. 54-56847 or 60-71260 in order to keep ink to be in the facing position with respect to the electrothermal transducing elements. In the present invention, the most effective method for the various kinds of ink mentioned above is the one that enables the film boiling method to be effectuated as described above.

What is claimed is:

1. A method for manufacturing a liquid jet recording head comprising the steps of:

forming a laminated body by depositing a liquid path formation layer defining a plurality of liquid paths on a metallic base board having a plurality of discharge energy generating elements disposed thereon;

cutting said laminated body to form an orifice surface; and grinding, simultaneously with said cutting step, said orifice surface, said cutting and grinding steps being executed using a side milling cutter provided with a rotational body, a plurality of cutting tools being held in different positions in the circumferential direction of said rotational body, and driving means for rotating said rotational body, and one of said plurality of cutting tools being provided with a tip edge having a larger rotational radius than that of each remaining tool to form a cut groove on a work piece as a cutting tool, while each of the remaining tools has a side edge to cut the side face of said cut groove as a finishing tool.

2. A method for manufacturing a liquid jet recording head according to claim 1, wherein said metallic base board comprises a material having at least one of aluminum and copper as a main component.

3. A method for manufacturing a liquid jet recording head according to claim 1, further comprising the step of providing a second base board of metal or resin on said liquid path formation layer.

4. A method for manufacturing a liquid jet recording head according to claim 3, wherein said second base board comprises a material containing as a main component at least one of aluminum, copper, polysulfone, polyethersulfone, amorphous polyolefin, phenol resin, polyetherimide, and polyphenylene sulfide.

5. A method for manufacturing a liquid jet recording head according to claim 1, wherein said cutting tool or milling cutter is provided with a diamond edge.

6. A method for manufacturing a liquid jet recording head according to claim 1, wherein the edge widths of the remaining tools of said side milling cutter are greater than the edge width of said cutting tool.

7. A method for manufacturing a liquid jet recording head according to claim 1, wherein the remaining tools of said side milling cutter are shifted relative to one another along the rotational axis of rotational body.

* * * * *

UNITED STATES PATENT AND TRADEMARK OFFICE

CERTIFICATE OF CORRECTION

PATENT NO. : 6,055,729

DATED : May 2, 2000

INVENTOR(S) : TOSHIO SUZUKI

It is certified that error appears in the above-identified patent and that said Letters Patent is hereby corrected as shown below:

ON COVER PAGE AT [30], FOREIGN APPLICATION PRIORITY DATA

Line "Dec. 24, 1995 [JP] Japan ..... 7-351844" should read --Dec. 27, 1995 [JP] Japan ..... 7-351844--.

COLUMN 2

Line 5, "cut cut" should read --cut--;
Line 24, "effect" should read --affect--;
Line 38, "whole" should read --as a whole--; and "making" should read --make--.

COLUMN 4

Line 51, "13 2." should read --13B.--.

COLUMN 5

Line 5, "$Si_2N_4$" should read --$Si_3N_4$--.

COLUMN 6

Line 29, "for" should be deleted;
Line 35, "burr B" should read --burr $B_1$--.

COLUMN 8

Line 31, "is" should be deleted;
Line 59, "SIC," should read --SiC,--;
Line 63, "$Ta_2O_5$," should read --$Ta_2O_5$--.

UNITED STATES PATENT AND TRADEMARK OFFICE

CERTIFICATE OF CORRECTION

PATENT NO. : 6,055,729

DATED : May 2, 2000

INVENTOR(S) : TOSHIO SUZUKI

It is certified that error appears in the above-identified patent and that said Letters Patent is hereby corrected as shown below:

COLUMN 11

Line 39, "and formed" should read --and is formed--;
Line 50, "where" should read --of--.

COLUMN 13

Line 26, "difference" should read --different--;
Line 44, "the" should be deleted;
Line 48, "liquefied" should read --liquified--;
Line 57, "liquefied" should read --liquified--;
Line 59, "liquefied" should read --liquified--.

COLUMN 14

Line 57, "of" should read --of said--.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*